United States Patent [19]

Matsuo

[11] 4,199,846

[45] Apr. 29, 1980

[54] END STOPPER FOR CONCEALED FASTENER

[75] Inventor: Hideaki Matsuo, Namerikawa, Japan

[73] Assignee: Yoshida Kogyo K.K., Tokyo, Japan

[21] Appl. No.: 964,463

[22] Filed: Nov. 29, 1978

[30] Foreign Application Priority Data

Dec. 5, 1977 [JP] Japan ..... 52/162932[U]

[51] Int. Cl.[2] ..... A44B 19/24

[52] U.S. Cl. ..... 24/205.11 R; 24/205 R

[58] Field of Search ..... 24/205.11 R, 205 R

[56] References Cited

U.S. PATENT DOCUMENTS 3,959,858 6/1976 Fukuroi ..... 24/205.11 R X 4,099,301 7/1978 Fujisaki ..... 24/205.11 R X

FOREIGN PATENT DOCUMENTS 457395 6/1949 Canada ..... 24/205.11 R

*Primary Examiner*—Philip C. Kannan

*Attorney, Agent, or Firm*—Hill, Van Santen, Steadman, Chiara & Simpson

[57] ABSTRACT

An end stopper for use with a concealed slide fastener in the fastened condition and devoid of the associated slider, is disclosed. The end stopper comprises a base portion and a pair of spaced clipping portions projected from the base portion. The plane containing the two clipping portions, which in combination can resiliently clip the abutting tape portion of the fastener, crosses the plane containing the base portion substantially at a right angle. The base portion is formed with an open space which is enough wide to compressively receive the element carrying portion of the fastener or the fastener edge portion devoid of the coupling elements and is spaceous enough to let pass through the element carrying portion of the fastener. In use, the end stopper prevents the coupling elements in the coupled condition from becoming disengaged even if the fastener be subjected to an external force application, and is effectively applied to a concealed fastener for use for example in joining together carpets or like articles.

11 Claims, 8 Drawing Figures

END STOPPER FOR CONCEALED FASTENER

BACKGROUND OF THE INVENTION

The present invention relates to an end stopper for concealed fasteners, for cheking unintended disengagement of coupled fastener elements of concealed fasteners utilized for joining together rugs, carpets, covers applied over cushioning material of chairs, or the like.

With slide fasteners generally in use in clothes or like articles, the fastener is shut by slidably moving the associated slider, which is then retained at one end portion of the coupled elements. However, with fasteners for use in joining together for example two carpet pieces, which are of a concealed type made externally invisible for aesthetical reasons, if the slider is left unremoved from the fastener after it is fastened, it protrudes and tends to impair the floor surface or form an obstacle to for example an article of furniture when it is to be moved. Also, the presence of a slider attached to the fastener makes the appearance of the joined carpet pieces impaired.

To avoid those difficulties, concealed fasteners of the type for use in connecting together carpets, covers or the like are generally devoid of a slider, and it therefore is required to apply an end stopper at the end portion of the fastener to prevent from occurring unintended disengagement of coupled fastener elements.

Conventionally, a stopper device of the sort under consideration has been known, which has such a structure in which two spaced clipping members are projected from a base member, and with such two clipping members, abutting portions (to be described) of two tapes of a fastener are clipped. In greater detail, this conventional stopper device is composed of coplanar base portion and two clipping portions formed substantially in a U-shape, and in use it only can nip the abutting portions of the fastener tapes with the two clipping members. Thus, if the stopper device is used in connection with a concealed fastener of a type including at its end portion a part devoid of coupling elements, depending on the length of such element-free part, the two clipping portions of the stopper device can clip only the abutting portions of the element-free end part of the fastener and cannot clip the tape end portion having coupling elements. Accordingly, when the fastener is subjected to bending at the terminal portion of the coupling elements, such conventional stopper device is easily prone to permit the engagement of elements to become released.

SUMMARY OF THE INVENTION

It is therefore a primary object of the present invention to provide an end stopper for concealed fasteners which, whether or not the fastener includes an end portion devoid of coupling elements, can securely clip endmost located fastener elements, and which, if a force is externally applied to the endmost located fastener elements in the coupled condition, can effectively prevent the coupling of the fastener elements from being unintentionally released.

To have the above object of the invention realized, the end stopper for concealed fasteners having coupling elements and fastener tapes supporting the coupling elements secured thereto, in accordance with the present invention, comprises a resilient material body having a base portion and a pair of spaced clipping portions projected from the base portion, and it has such a structure in which the space between the two clipping portions is so provided as to therein compressively receive the abutting portions of the fastener tapes and the base portion is bent relative to the clipping portions in a manner such that the plane containing the base portion and that containing the clipping portions will cross each other, and in which the base portion has an open space, which is wide enough to therein compressively receive element carrying portions of the fastener or fastener end portions devoid of coupling elements and is great enough to let the element carrying portion pass through.

The end stopper of the present invention may include, in a specific example thereof, also a bent portion in connection with the base portion thereof. The bent portion may comprise such a structure in which the base portion is bent and extended to the direction in which the clipping portions are projected, and parallel to and with a space from the clipping portions.

Herein, the "abutting part or portion" of the two fastener tapes means the portion at which fold portions of the two element carrying tapes of the fastener abut each other to conceal the coupled elements, and in practice, its width corresponds to the thickness of for example two tapes as later to be described.

Also, the "element carrying portion" herein termed basically means the portion of the fastener comprising a selvage portion of the tape to which the coupling elements are secured, coupling elements per se, and a cord applied through the elements.

With the end stopper of the present invention, the coupling elements located at a longitudinal end portion of the fastener can be securely nip-wise held by the clipping portions, regardless whether the fastener includes an end portion devoid of the coupling elements, and accordingly unintended release of the coupling elements can be positively prevented from occurring. Also, the end stopper of the present invention can be applied to the concealed fasteners with ease, and even if the fastener be subjected to an external force application, the coupled fastener elements can be checked against disengagement.

DETAILED DESCRIPTION OF THE PREFERRED EMBODIMENTS OF THE INVENTION

With reference to the accompanying drawings, the present invention will now be described in greater detail in conjunction with specific examples thereof.

Figure 1:
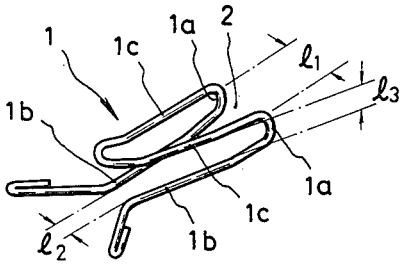
FIG. 1 is a perspective view, showing an example of the end stopper according to the present invention.
Figure 2:
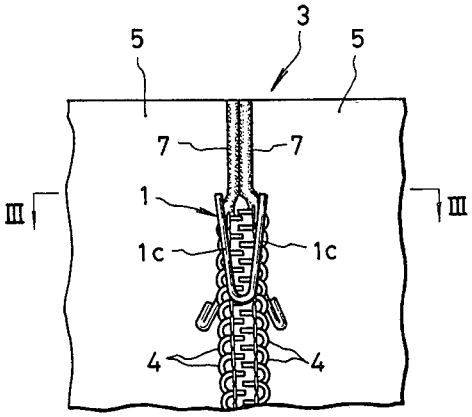
FIG. 2 shows a rear view of the end stopper of FIG. 1 in use as applied at the end portion of a concealed fastener.

Initially in FIG. 1, the end stopper therein generally indicated at the numeral 1 comprises a resilient material body made of a metal wire or a wire-like product of a synthetic resin. The end stopper 1 comprises a base portion 1*a* and 1*a*, a pair of spaced clipping portions 1*b* and 1*b* respectively connected to and projected from one end of the base portion, and bent portions 1*c* and 1*c* projected from the other end of the base portion, parallel to clipping portions.

The plane containing base portion 1*a* and 1*a* crosses the plane containing the clipping portions 1*b* and 1*b*, and in the embodiment of the present invention under consideration, the clipping portions 1*b* and 1*b* are bent substantially at 90° relative to the base portion 1*a* and 1*a*.

The base portion 1*a* and 1*a* has an open space 2 of a distance or width $l_1$.

The pair of spaced clipping portions 1*b* and 1*b* are diverged toward the forward ends thereof. In the illustrated embodiment under reference, forward end portions of clipping members 1*b* and 1*b* are bent to depart from each other, and at the point of bending the two clipping portions have a smallest distance $l_2$ from each other so as to nip-wise maintain unseparable the two fastener tapes of a fastened fastener end portion, in use. In greater detail, the distance between the clipping portions 1*b* and 1*b* is smaller toward the forward ends of the clipping portions from the side of the base portion 1*a* and 1*a*, and at an intermediate point or at a point near the forward end, the clipping portions are bent away from each other.

The bent portions 1*c* and 1*c* are connected to and projected from the base portion 1*a* and 1*a* substantially the same as clipping portions 1*b* and 1*b*, with a space $l_3$ provided between them and the clipping portions. At the forward end portions of bent portions 1*c* and 1*c*, the space $l_3$ is increased in its distance between the bent portion 1*c* and the clipping portion 1*b*, and in the present embodiment such increase in the distance $l_3$ is provided by bending the forward end portions of bent portions 1*c* and 1*c*.

FIGS. 2 through 5 are taken for illustration of the manner of application of the end stopper of FIG. 1 to a concealed fastener generically shown at 3.

The concealed type fastener 3 comprises, essentially, coupling elements 4 made of a metal or synthetic resin material, fastener tapes 5 made of a woven fabric or the like and supporting the coupling elements 4 secured thereto, and cords 6 applied through the coupling elements and supporting the same. Each fastener tape 5 is double folded and has a selvage portion 5*a* and a fold portion 5*b*.

The open space 2 of the base portion 1*a* and 1*a* of the end stopper 1 has the width $l_1$ as before stated, which is wide enough to compressively receive therein the element carrying portions of the fastener tape 5 or fastener edge portions 7 and 7 devoid of the coupling elements, and at the same time it is enough spaceous to let pass through the element carrying portions.

Figure 3:
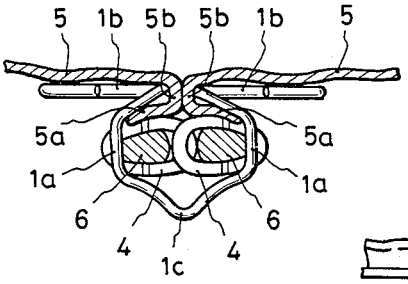
FIG. 3 is a cross section taken along the line III—III of FIG. 2.

The distance $l_2$ between clipping portions 1*b* and 1*b* is great enough to compressively receive therein the abutting portion of the fastener tapes of the fastener 3. As illustrated in FIG. 3, the abutting portion of the two fastener tapes above mentioned corresponds to the fold portion 5*b* of each fastener tape 5, and in this example of the end stopper, the distance $l_2$ substantially corresponds to the thickness of two fastener tapes 5 and 5 put together.

Figure 4:
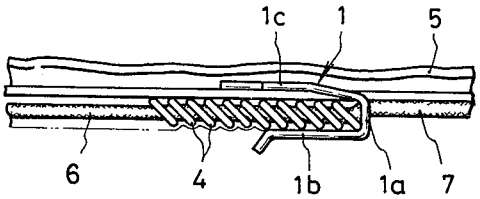
FIG. 4 represents a side elevational view of the end stopper shown in FIG. 2, seen at the right of FIG. 2.
Figure 5:
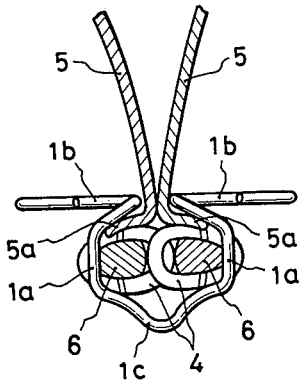
FIG. 5 is a cross-sectional view of the end stopper of FIG. 1 with the fastener tapes in a condition of being upwardly bent.

Further, as shown in FIGS. 3 through 5, the distance $l_3$ between the clipping portion 1*b* and the bent portion 1*c* of the end stopper 1 is virtually the same as or slightly smaller than the thickness of the coupling portion of the concealed fastener 3, and in the present example, the thickness of the coupling portion corresponds to the thickness of the tape selvage portion 5*a* and that of the coupling elements 4 in aggregation.

In use, the end stopper 1 is applied to the concealed fastener 3 in the fastened condition by inserting it from the longitudinal end portion of the coupled elements. In practice, the open space 2 of the end stopper 1 is great enough to permit the element carrying portions of the fastener tapes 5 to pass through, and the end stopper can be applied by inserting it from the side of the clipping portions 1*b* and the bent portions 1*c*, with the former portions at the side of the selvage portions 5*a* of the fastener tapes 5 and the latter the side of coupling elements 4, so as to have passed through the open space 2 the end portion of the fastener edge portions 7 connected from the longitudinal end of the fastener 3 until the base portion 1*a* of the end stopper 1 bears against the endmost one of the coupling elements 4.

Thus, as shown in FIGS. 2 through 5 the clipping portions 1*b* of the end stopper 1 are inserted between the fastener tapes 5 and their selvage portions 5*a*, tightly clipping the abutting portions of the fastener tapes between them, and the base portion 1*a* resiliently nip the element carrying portion or fastener edge portions 7 devoid of the coupling elements, with the bent portions 1*c* and 1*c* externally covering and pressing the coupling elements 4.

The end stopper 1 of the present invention having the above structural features brings about the following operational effects and advantages:

(1) The fastener edge portions 7, free of the coupling elements, and the abutting portions of the fastener tapes 5 are resiliently nipped by the base portion 1*a* and the clipping portions 1*b* of the end stopper 1, respectively, so that unintended disengagement of the coupled elements can be effectively prevented from occurring.

(2) The coupling elements are resiliently nipped at their end portions by the end stopper 1, so that even if a longitudinal end portion of the fastener, particularly that of the coupling elements, be subjected to bending, the elements in the coupled condition can be maintained free of a risk of being released from engagement, and thus the end stopper of the present invention can be effectively applied to a concealed fastener having no end portion devoid of the coupling elements.

(3) The base portion 1*a* resiliently engages the boundary of the endmost one of the coupling elements and the element-free fastener edge portions 7, so that if two fastener tapes 5 are pulled in vertically opposing directions at the end portion of the fastener, the engagement of the coupled elements can be maintained intact, with the so-called "splitting" of the fastener elements effectively checked. In addition, even if the two fastener tapes 5 are bent as shown in FIG. 5 and an external force application be made in a direction other than the directions parallel to the longitudinal direction of the fastener, the end stopper 1 would not be removed.

(4) The coupling elements located near the fastener end can be tightly clipped between clipping portions 1*b* and bent portions 1*c*, so that even if the clipped portion of the coupling elements be subjected to bending, the end stopper can be stably held in position.

(5) The forward end portions of clipping portions 1*b* are diverged from each other and the forward end portion of the bent portions 1*c* is also bent to depart from the clipping portions 1*b*, so that the insertion application of the end stopper 1 can be made with ease.

Figure 7:
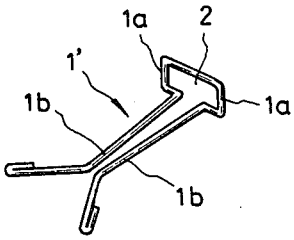
FIGS. 6, 7 and 8 are perspective views, respectively illustrating a further example of the end stopper according to the present invention.
Figure 6:
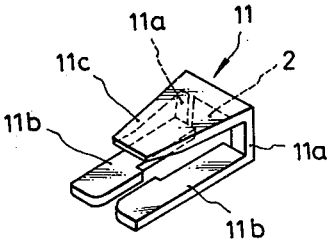
Figure 8:
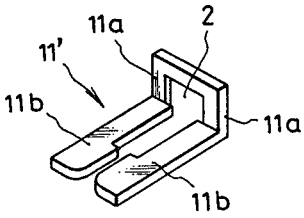

FIGS. 6, 7 and 8 respectively show a further example of the end stopper according to the present invention.

Initially, the end stopper 11 in FIG. 6 comprises a plate-like resilient material body made of a metal plate or a synthetic resin plate. Similar to the end stopper 1 illustrated in FIG. 1, the end stopper 11, too, has a base portion, spaced clipping portions projected from the base portion and a similarly projected bent portion, respectively indicated by 11*a*, 11*b* and 11*c*. The base portion 11*a* and 11*a* has an open space 2. The width and size of this space 2, the distance between the two spaced clipping portions 11*b* and the distance between the clipping portions 11*b* and the bent portion 11*c* are the same as those of the end stopper 1 shown in FIG. 1. Further, the base portion 11*a* and clipping portions 11*b* are formed in an arrangement such that the plane containing the base portion 11*a* and that of the clipping portions 11*b* will cross each other.

The distance between the two clipping portions 11*b* and 11*b* are broader at the side of the base portion 11*a*, and the forward end portions are diverged by being notched to be round so that the insertion application of the end stopper can be facilitated.

The forward end portion of the bent portion 11*c* is tapered about its side facing the clipping portion 11*b* in a manner of diverging from the clipping portion.

The end stopper 11 shown in FIG. 6 can be put for use in a same way as the end stopper 1 of FIG. 1. Also, the end stopper 11 has substantially the same structure as the end stopper 1, and it accordingly can attain same advantages as recited in connection with the end stopper 1 before.

The end stopper 1' illustrated in FIG. 7 has an identical structure with the end stopper 1 of FIG. 1, except that it is devoid of bent portions 1*c* of the stopper 1.

Likewise, the end stopper 11' in FIG. 8 is structurally identical with the end stopper 11 of FIG. 6, except that it has no bent portion comparable to the bent portion 11*c* of the end stopper 11.

The end stopper 1' and 11' illustrated in FIGS. 7 and 8, respectively, can be used in a same manner as the end stoppers 1 and 11 of FIGS. 1 and 6, respectively, to attain substantially the same advantages as those attained by the end stoppers 1 and 11, except that the clipping performance done by the clipping portions and the bent portions in combination in the instance of the end stoppers 1 and 11 is not made in the case of the end stoppers 1' and 11'.

The end stopper for the concealed fasteners according to the present invention can be manufactured in an integral body for example by molding a metal or synthetic resin material or by bending and/or cutting a wire-like or plate-like material.

It is to be noted that the particular shapes and structures of the end stopper described above in conjunction with the illustration in several figures of the drawings can be variously modified without departing from the concept of the present invention, and all modifications and changes in the structure or configuration so made should be construed to lie within the scope of the present invention.

What is claimed is:

1. An end stopper for concealed fasteners having coupling elements and fastener tapes supporting said coupling elements secured thereto, comprising a resilient material body having a base portion and a pair of spaced clipping portions projected from said base portion, said clipping portions in combination resiliently clipping the abutting portions of said fastener tapes, said base portion being bent in a manner such that the plane containing the base portion and the plane containing said clipping portions will cross each other, said base portion having an open space, which is enough wide to therein compressively receive element carrying portions of said fastener tapes or fastener edge portions devoid of said coupling elements and is spaceous enough to permit said element carrying portions to pass through.

2. An end stopper for concealed fasteners as claimed in claim 1, in which said pair of spaced clipping portions are diverged toward the forward ends thereof.

3. An end stopper for concealed fasteners as claimed in claim 2, in which said pair of spaced clipping portions are diverged by bending the forward end portions thereof.

4. An end stopper for concealed fasteners as claimed in claim 2, in which said pair of spaced clipping portions are diverged by notching the mutually facing sides of the forward end portions thereof.

5. An end stopper for concealed fasteners as claimed in claim 1, in which said pair of spaced clipping portions are provided so as to have a distance therebetween smaller toward the side of the forward end of the clipping portion from the side of said base portion.

6. An end stopper for concealed fasteners as claimed in claim 1, in which said plane containing said base portion and said plane containing said clipping portions cross each other substantially at 90° .

7. An end stopper for concealed fasteners as claimed in claim 1, in which said base portion further includes a bent portion projected from said base portion in the same direction in which said clipping portions are projected, parallel to and spaced from said clipping portions.

8. An end stopper for concealed fasteners as claimed in claim 7, in which said spaced bent portion and clipping portions have a distance substantially the same as or slightly smaller than an aggregation of the thickness of a selvege portion of said fastener tape and that of said coupling elements.

9. An end stopper for concealed fasteners as claimed in claim 7, in which said spaced bent portion and clipping portions are diverged toward the forward ends thereof.

10. An end stopper for concealed fasteners as claimed in claim 9, in which said spaced bent portion and clipping portions are diverged by bending a forward end portion of said bent portion.

11. An end stopper for concealed fasteners as claimed in claim 9, in which said spaced bent portion and clipping portions are diverged by notching a forward end portion of said bent portion.

* * * * *